US005971564A

United States Patent [19]

Wang

[11] Patent Number: 5,971,564

[45] Date of Patent: Oct. 26, 1999

[54] PL LAMP HOLDER

[75] Inventor: Chen-Feng Wang, Taipei, Taiwan

[73] Assignee: Powerone Electronic Co., Ltd., Taipei, Taiwan

[21] Appl. No.: 09/046,732

[22] Filed: Mar. 24, 1998

[51] Int. Cl.[6] ..... F21K 5/00

[52] U.S. Cl. ..... 362/263; 362/216; 362/221; 362/265; 362/318.01; 362/318.04; 362/318.05; 362/318.09

[58] Field of Search ..... 362/216, 221, 362/263, 268; 313/318.01, 318.04, 318.05, 318.09

[56] References Cited

U.S. PATENT DOCUMENTS 5,577,835 11/1996 Huang ..... 362/353

*Primary Examiner*—Sandra O'Shea
*Assistant Examiner*—John A. Ward
*Attorney, Agent, or Firm*—Rosenberg, Klein & Bilker

[57] ABSTRACT

The present invention of a PL lamp holder comprises a holder shell, a holder body, and a holder mount for connecting the holder shell to the holder body. The holder shell is formed of funneled shape having a conical body, the holder body has a PL lamp on an upper portion of a cylindrical body and a lower portion formed of an annular wall extended downwardly therefrom, and the holder mount comprises a short barrel having a lower barrel wall and a linging wall pan in a smaller outside diameter having an annular upward pan wall with an outward flange connected to the inner surface of the barrel and formed a narrow annular groove.

3 Claims, 8 Drawing Sheets

PL LAMP HOLDER

FIELD OF THE INVENTION

The present invention relates to PL lamp holder, and more particularity relates to an improved structure of a PL lamp which is easy to replace and maintain safety and convenience when damaged.

BACKGROUND OF THE INVENTION

The inventor of U.S. Pat. No. 5,577,835, Peter Huang, is the applicant of this invention. The inventor of this art, Peter Huang, is one of Ever Success Lighting Co., LTD's engineers. This present invention provides an improved of U.S. Pat. No. 5,577,835.

According to the prior art, the structure of the PL (parallel flourescent tubes lamp) lamp includes a holder shell coupled to a holder body, and the holder body is to hold two parallel lamp tubes. Two rectangular holes disposed on the holder body are inserted for rectangular flanges. This is easy to loose the connection between the holder shell and the holder mount so that the electronic ballast circuit board can not been firmly fastened. It is also easy to break the conductor between the electronic ballast circuit board and two contact metal plates during using. The connection between the holder body and the holder mount is not stable in which two metal plates are exposed outside so that it will cause electric shock. Besides, the structure of the holder body is complicated, and the holder shell and the holder mount can not hook each other closely so that electric contact error tends to happen and the lamp tubes become useless.

SUMMARY OF THE INVENTION

It is one object of the present invention to provide an improved structure of a PL lamp holder, wherein two metal plates on the holder body are respectively inserted into two opposite grooves of the holder mount and then swivelly hooked by a lateral groove of the holder mount respectively, and the annular flange of the downward holder mount is inserted into the mounting groove of the holder shell so that the holder body, the holder shell and the holder mount are effectively joined together in order to reduce the holder damaged during using.

It is another object of the present invention to provide an improved structure of a PL lamp holder which is easy to assemble, replace and maintain by consumers.

BRIEF DESCRIPTION OF THE DRAWINGS

The present invention can be better understood by detailed descriptions of the follow drawings, in which.

DETAILED DESCRIPTION OF THE PREFERRED EMBODIMENT

Figure 1:
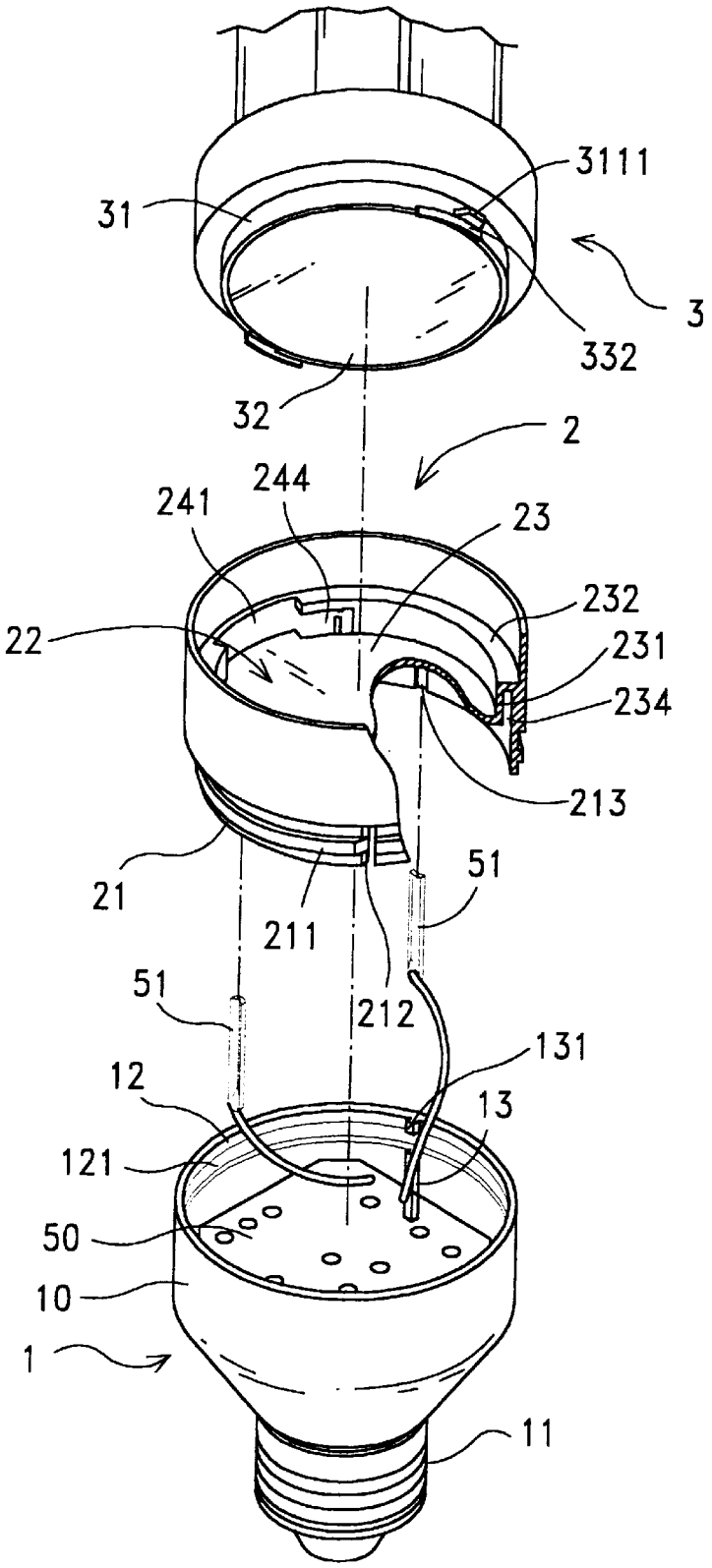
FIG. 1 is an elevational view showing the three main subassemblies of a PL lamp holder according to the present invention ready for assembling.

Please refer to FIG. 1, the present invention comprises a holder shell 1, a holder mount 2 and a holder body 3.

The holder shell 1 is formed of a funneled shape including a conical shell body 10, a screw type metal base 11 at a reduced bottom portion of the shell body 10 for fitting to a conventional lamp socket, an electronic ballast circuit board 50 provided therein having two arch sectional metal terminal strips 51 respectively connected to the end of a conductor leaded from the circuit board 50, and a cylindrical wall 12 disposed at a top of the conical shell body 10 having a plurality opposite pairs of vertical thin tenons 13 evenly distributed on the inner surface thereof, an annular gloove 121 disposed in the inner surface of the wall 12 cutting each tenon 13 formed of a separated tenon head 131 thereon.

Figure 2:
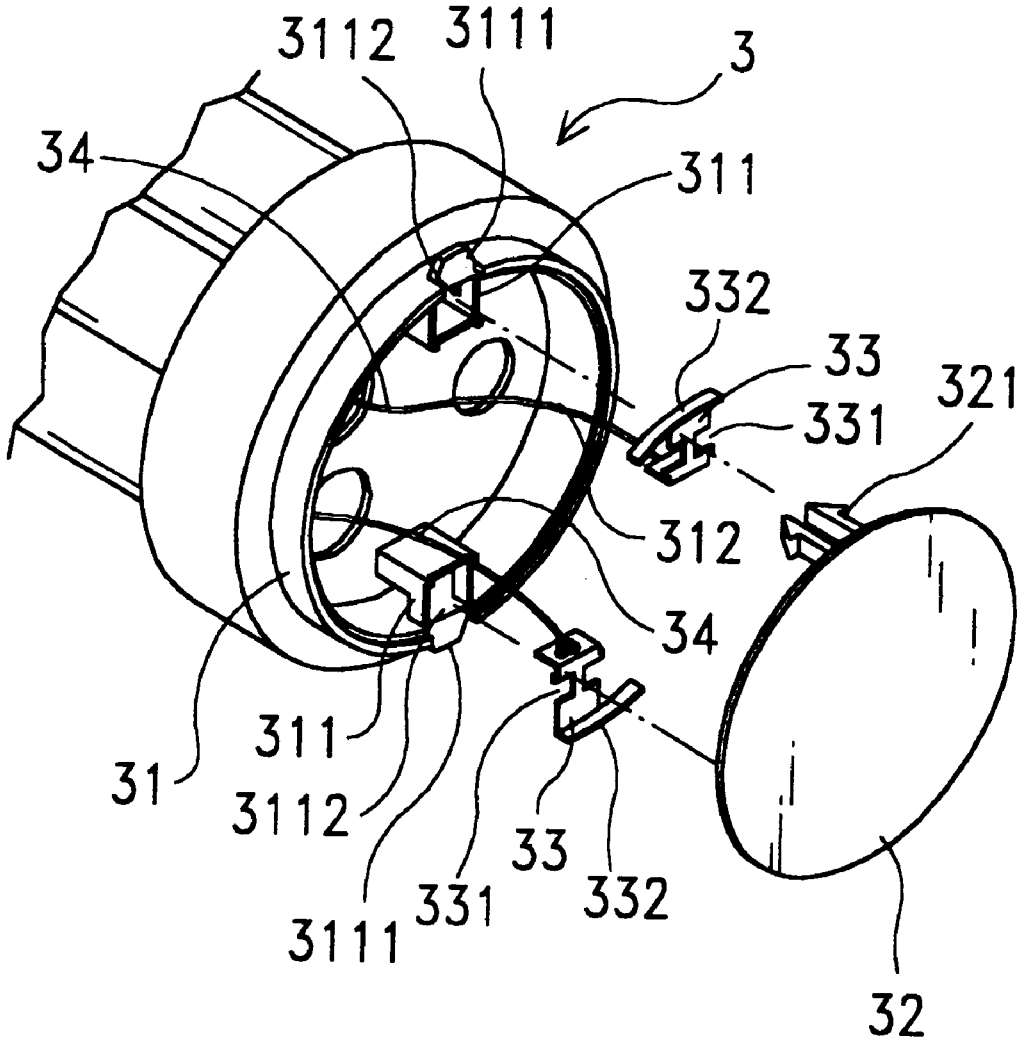
FIG. 2 is an exploded view of the lower portion of a holder body.

The holder body 3 consists of a conventional upper portion (not labeled) for mounting the PL lamp thereon and a lower portion according to the present invention formed of an annular wall 31 having two opposite tenon pieces 3111 jutted outwardly from the annular wall 31 near the bottom respectively having a corresponding notch 3112 disposed on the bottom edge of the annular wall 31 under the tenon piece 3111. Please refer to FIG. 2, which shows the inside of the holder body 3 having two opposite rectangular connecting recesses 311 disposed on the inner surface of the annular wall 31 respectively adjacent to the tenon piece 3111; two metal conducting piece 33 each formed of a "I" shape plate covered on the rectangular recesses 311 having an outer end extended out from the notch 3112 with a curved contacting flap 332 downwardly folded from the extended end and elongated clockwisely around the periphery of the bottom edge of the annular wall 31 under the tenon piece 3111, and an upward folded piece 331 disposed to an opposite end closed on one side of the rectangular recesses 311 for soldering to be a lend wire 312 of the PL lamp thereon; a bottom cover 32 having two opposite pairs of snaps-in connecting hooks 321 for snapping into the rectangular recesses 311, each pair of hooks 321 having an inserted space for holding the slim portion of the "1" shaped metal conducting piece 33 firmly therein.

The holder mount 2 is composed of a short barrel 20 having a lower barrel wall 21 in a smaller outside diameter for mounting into the cylindrical wall 12 of the holder shell 1, and a longing pan 23 disposed inside the barrel 20 having an upward annular pan wall 231 with an outward flange 232 at a top connected to the surface of the barrel 20 formed of an upper recess 22 for receiving the lower portion of the holder body during assembling, and a narrow annular groove 234 between the pan wall 231 and the barrel 20 under the flange 232 for hiding the arch sectional metal strip and the curved contacting flaps 332 and been squeezed to firmly contact, an outward ring 211 disposed on a periphery of the lower barrel wall 21, and a plurality of slots 212 corresponding to the tenons 13 of the holder shell 1 cutting the lower barrel wall 21 into sections to maintain an elasticity for assembling, two dovetail slots 213 oppositely disposed on the inner surface of barrel 20 from a bottom edge up to the root of the flange 232 two opposite "L" shaped notches respectively formed of a wide vertical notch 241 cutting the flange 232 and the pan wall 231 for passing the contacting flaps 332 therefrom, and a lateral notch 244 extended clockwisely from the vertical notch 241 under the flange 232 for receiving the tenon piece 3111 of the holder body 3 therein during assembling.

Figure 3:
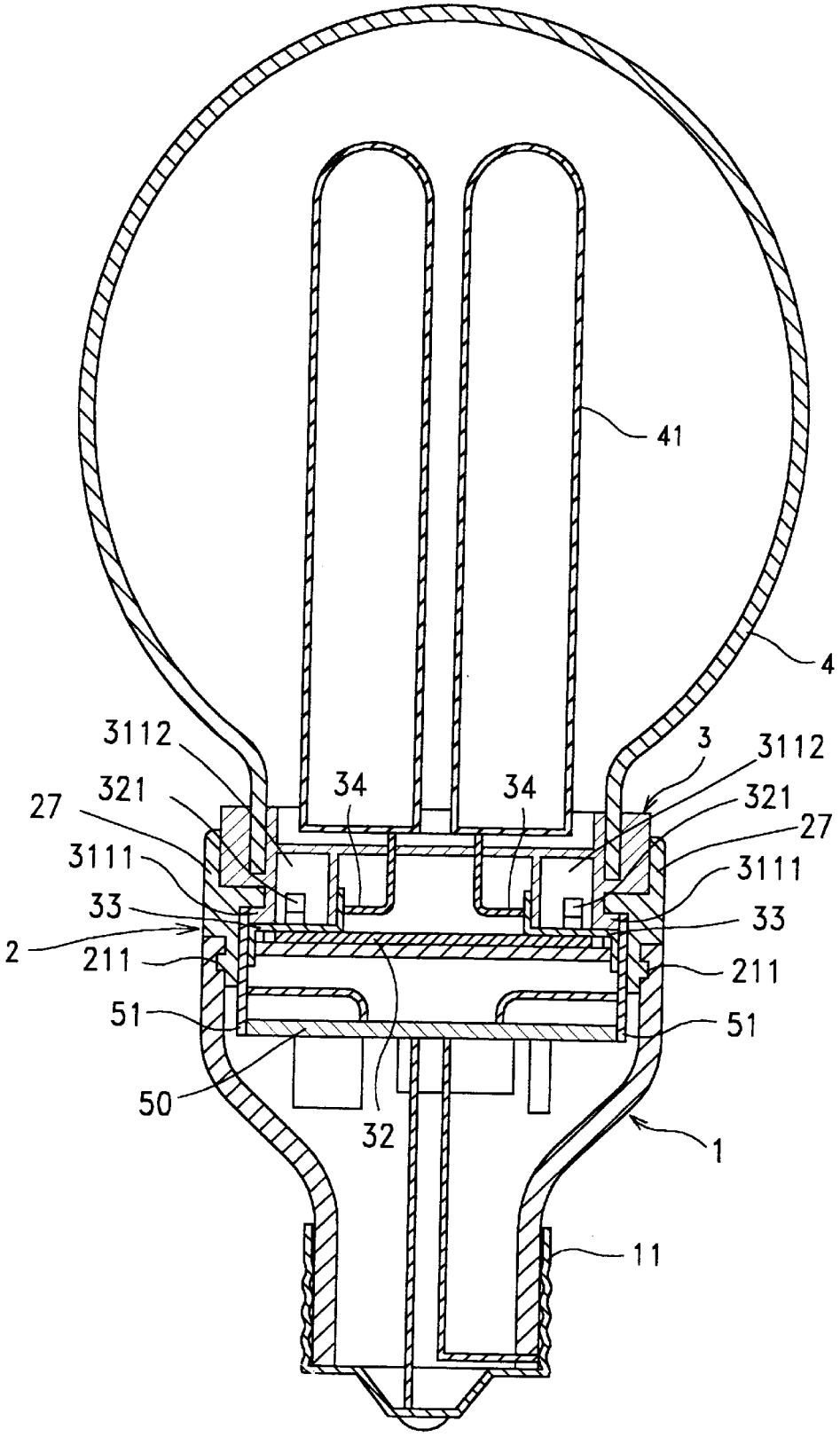
FIG. 3 is a sectional view of the PL lamp holder according to the present invention.
Figure 4:
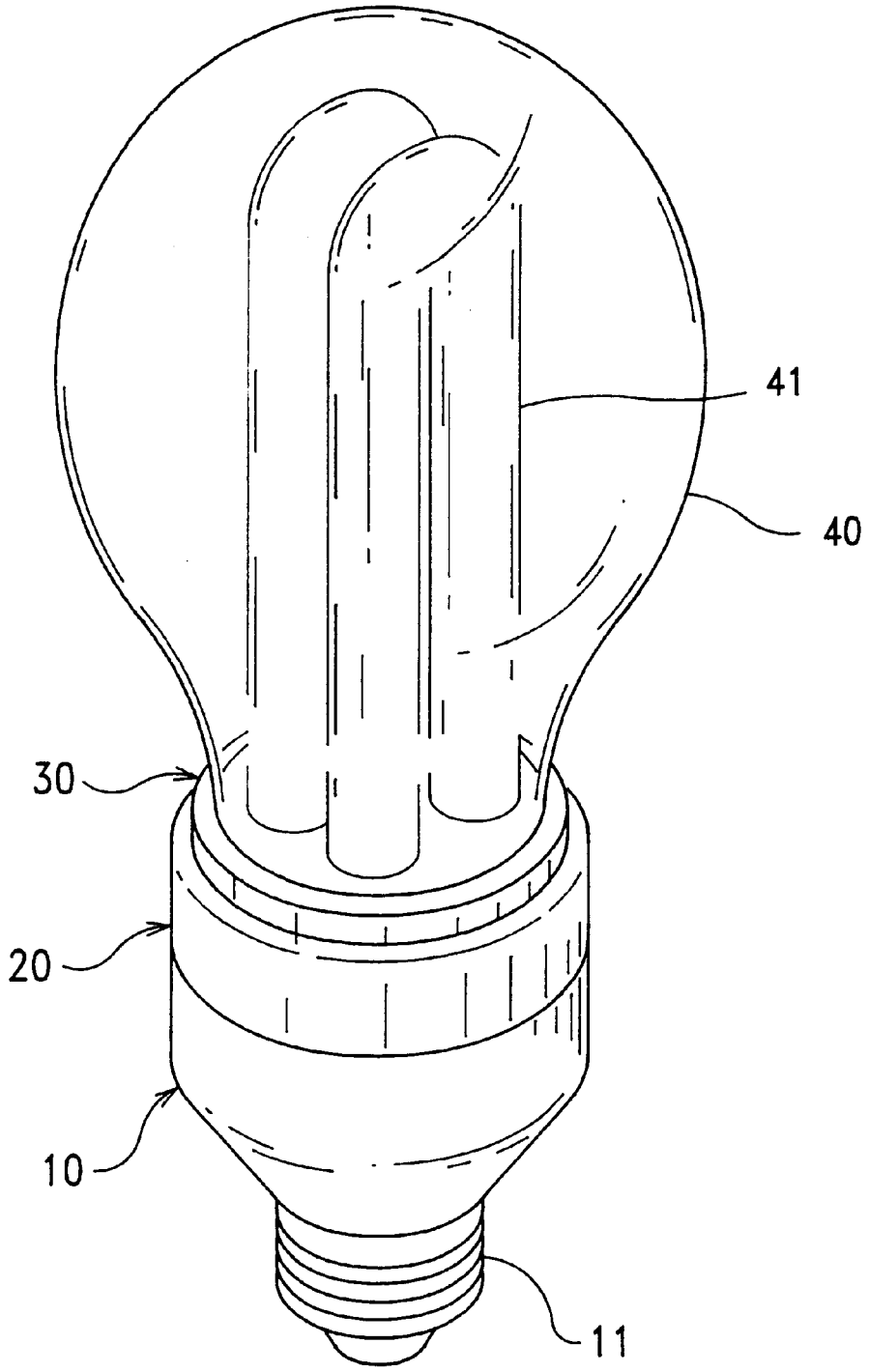
FIG. 4 to FIG. 8 show different kinds of decorative bulbs used for the present invention.
Figure 5:
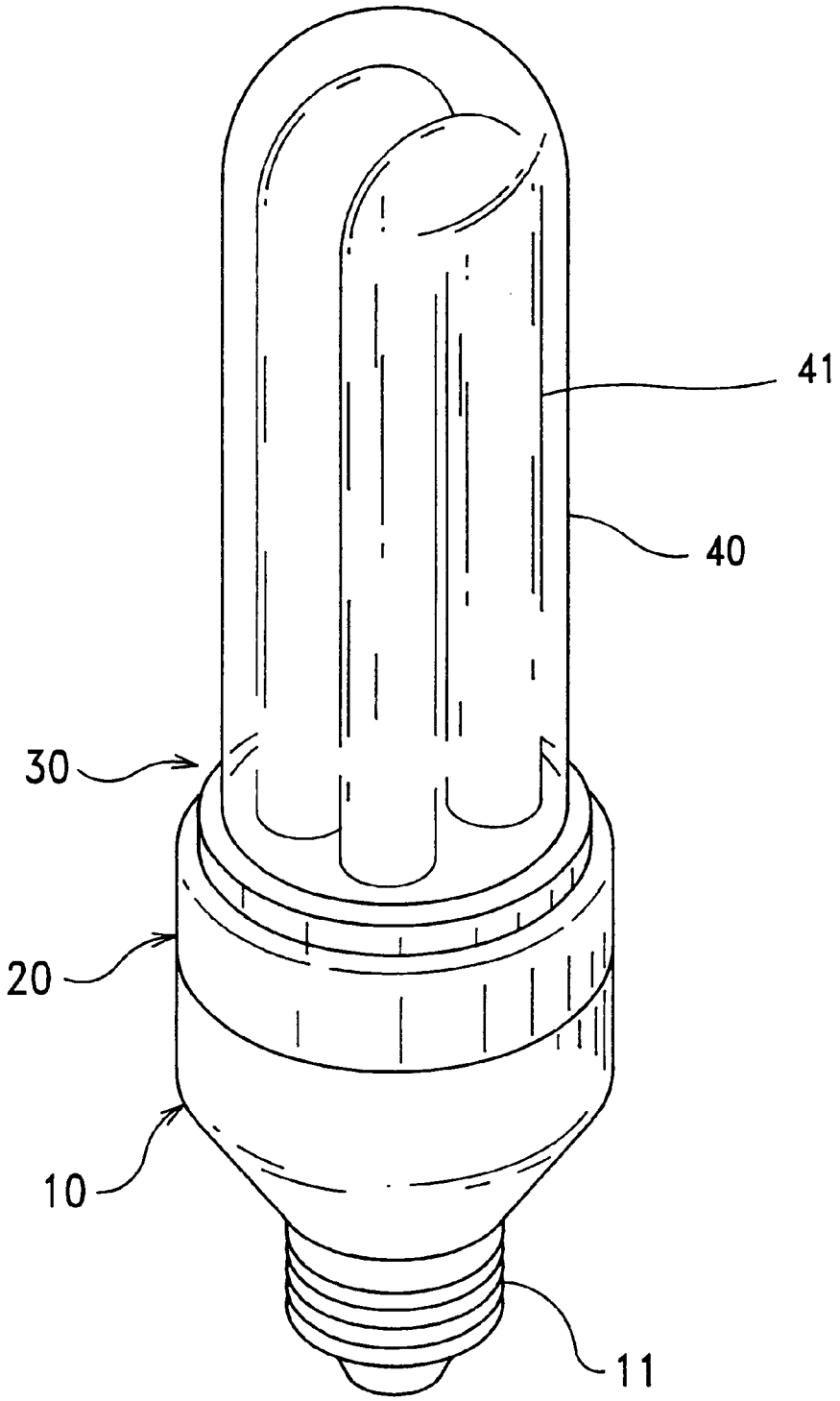
Figure 6:
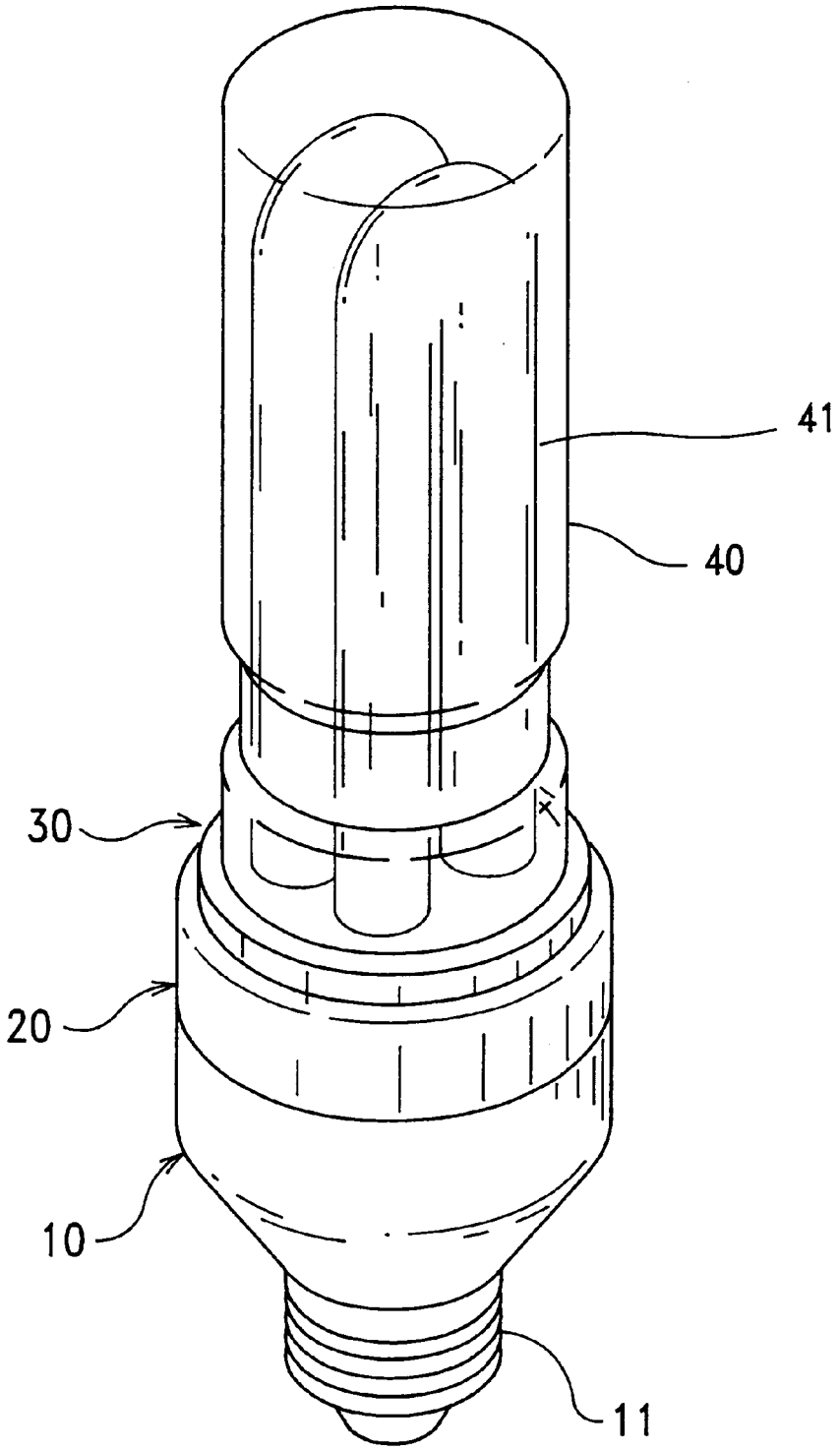
Figure 7:
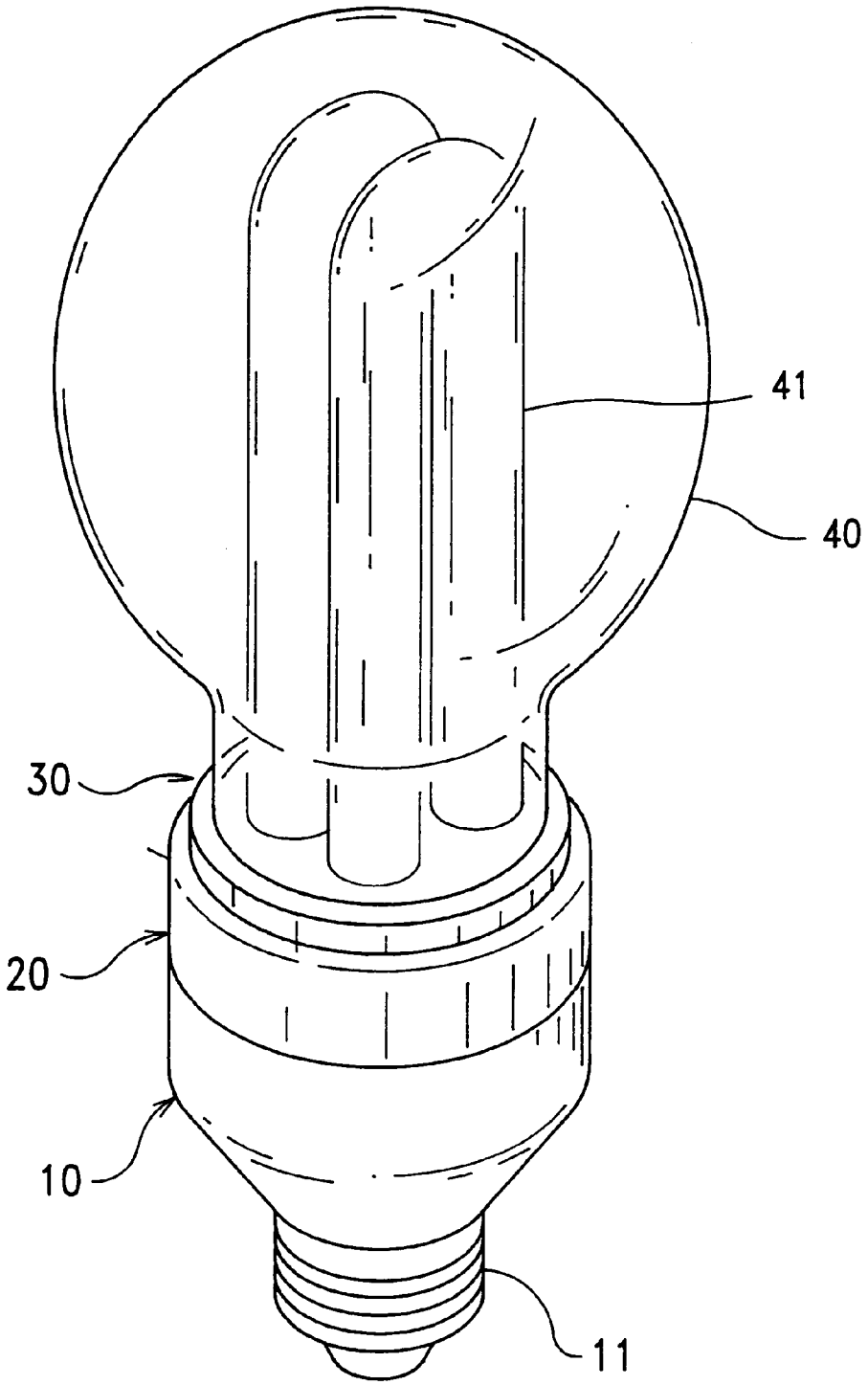
Figure 8:
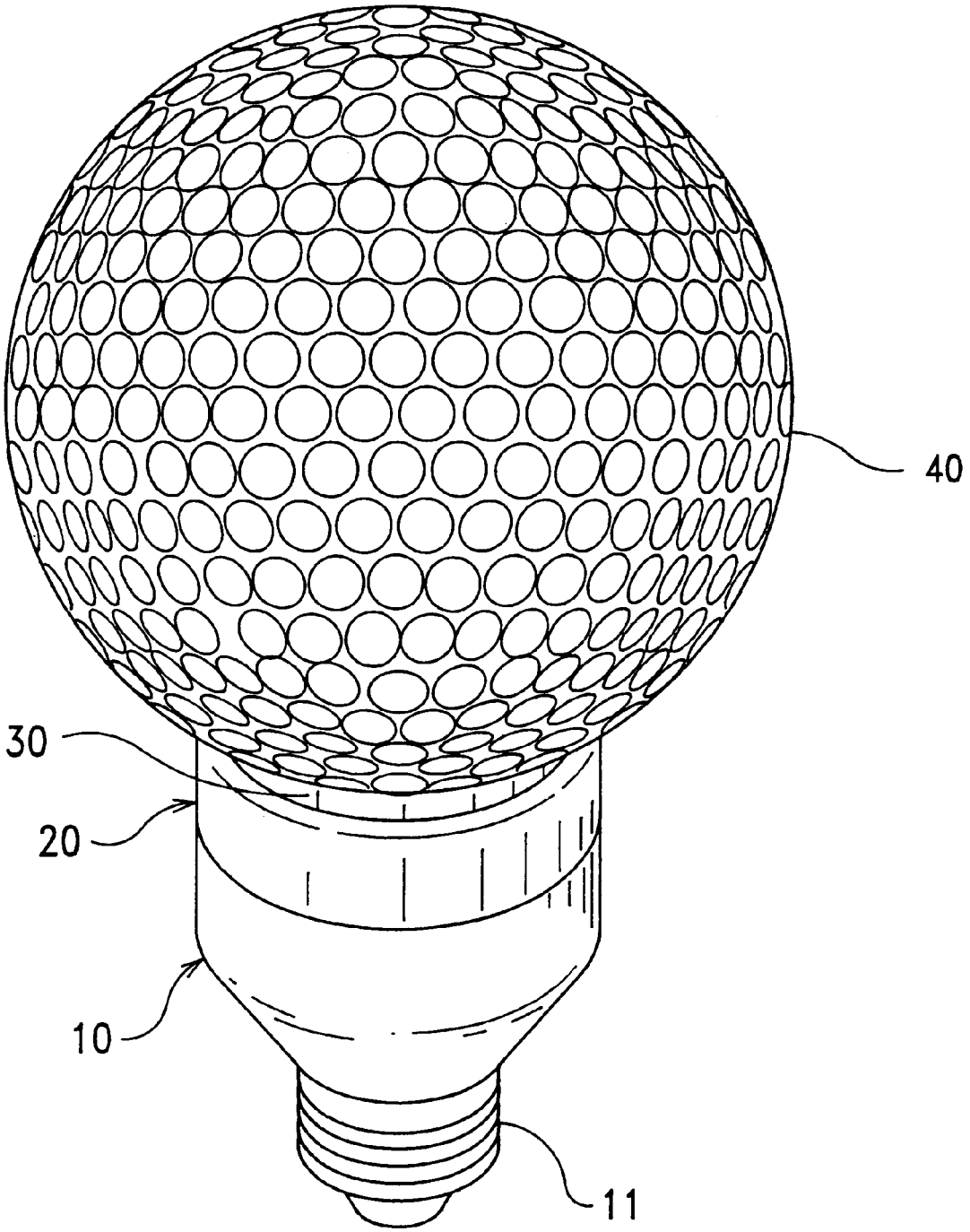

Please refer to FIG. 3, and FIG. 1 again. In FIG. 1, the PL lamp holder is ready for assembling and FIG. 3 shows a sectional view of a PL lamp holder which has been fully assembled, in which the holder 1 will be assembled onto the holder mount 2 firstly by inserting the arch sectional metal strips 51 of the holder shell 1 into the dovetail slots 213 in the lower wall 21 of the holder mount 2, then alining the slots 212 of the lower portion 21 of the holder mount 2 with thin tenons 13 of the holder shell 1, in which the thin tenons 13 have the thickness not enough to engage with slots 212 but enough to engage with the notches of the outward ring 12, then forcing the outward ring 211 of the holder mount 2 into the annular gloove 121 of the holder shell 1 for a first lock and then turning the holder mount 2 against the holder shell 1 for a certain angle to let the outward ring 211 caught by the tenon heads 131 for a second lock so as to provide double locks therefore. After the holder shell 1 has been mounted on the holder mount 2, the holder body 3 will be assembled onto the holder mount 2 simply by inserting the annular wall 31 of the holder body 3 into the cylinder wall 21 to let the contacting flaps 332 and the tenon piece passing through the wide vertical notches 241 of the pan wall 231 then turning the holder body 3 clockwisely against the holder mount 2 for moving the tenon piece 3111 and the contacting flaps 332 into the lateral notches 244 and held firmly by the pan flange 231, in same time the elongated end of each contacting flap 332 will be forced into the annular gloove 234 to contact with respective arch sectional metal terminal strip 51 for supplying the electrical power to the PL lamp, the contacting flap 332 has a gradually thinner end for easy to guide itself into the narrow space between the pan wall 21 and the arched back of the terminal strip 51 in the narrow annular groove 234, during the holder body 3 is continuously turned for assembling, then the arch sectional terminal gloove 234 is slightly to assure a dead contact between the contacting flaps 332 and the terminal strip 51 unable to loosen.

I claim:

1. A PL lamp holder comprises a holder shell, a holder body, and a holder mount for connecting said holder shell to said holder body;

said holder shell formed of funneled shape having a conical shell body, a screw type metal base at a reduced bottom of said conical shell body for fitting to a conventional lamp socket, a cylindrical wall provided at a top of said conical shell body having a plurality opposite pairs of vertical thin tenon evenly distributed on the inner surface of said cylindrical wall and an annular groove disposed thereat to cut each of said vertical tenon into head, an electric ballast circuit board mounted in said conical shell body having two lead wires respectively connected to a arch sectional terminal metal strip for supplying electrical source to the lamp;

said holder body having a PL lamp mounted on an upper portion of a cylindrical body and a lower portion formed of an annular wall extended downwardly therefrom, two rectangular connecting recesses disposed on the opposite side in said annular wall and two opposite tenon piece jutted outwardly from the outer edge of said annular wall adjacent to said rectangular recess, two metal conducting piece each formed of a "I" shape plate covered on said rectangular recess respectively having a upward fold piece soldered to a lead wire of said PL lamp, and a downward fold contacting extended to the outer edge of said annular wall under said tenon piece, a bottom cover having two opposite pairs of Snap-in connecting hooks for snapping into said rectangular connecting recesses respectively crossed over said "I" shape plate of said metal conducting piece and been held firmly therein;

said holder mount comprising a short barrel having lower barrel wall and a linging pan in a smaller outside diameter having an annular upward pan wall with an outward flange connected to the inner surface of said barrel and formed a narrow annular groove between said barrel and said pan wall under said flange thereof, said lower barrel wall having an outward ring disposed thereon and a plurality of notches corresponding to said thin tenons of said holder shell to cut said lower portion annular wall into sections, the inner surface of said lower portion annular wall of said barrel from a bottom edge to the root of said flange of said linging pan, two "L" shaped notches oppositely cutting said flange and said pan wall of said linging pan for mounting said holder body therefore.

2. A PL lamp holder according to claim 1 wherein said holder shell is mounted onto said holder mount having a double-lock means which a first lock is provided by said outward ring on the periphery of said lower barrel of said holder mount snapped into said annular groove in said cylindrical wall of said holder shell while a second lock is provided by that said outward ring will by caught by said tenon heads when said holder mount is turned to a certain angular against said holder shell after they are snapped together.

3. A PL lamp holder according to claim 1 wherein a dead contact is provided between each said arch sectional terminal metal strip and said contacting flap of said metal conducting piece, which said terminal metal strip is firmly in said dovetail slot an inner surface of said barrel wall in said narrow annular groove while said contacting flap is forced into said narrow annular groove and squeezed against said terminal metal strip to assure that the contact is anable to loosen.

* * * * *